United States Patent [19]

Meighan

[11] 4,062,448

[45] Dec. 13, 1977

[54] SUPPORT MEMBER FOR SHRINK WRAPPED ARTICLES

[75] Inventor: James Meighan, Newcastle upon Tyne, England

[73] Assignee: The Procter & Gamble Company, Cincinnati, Ohio

[21] Appl. No.: 656,926

[22] Filed: Feb. 10, 1976

[30] Foreign Application Priority Data

Feb. 12, 1975 United Kingdom ..... 6049/75

[51] Int. Cl.[2] ..... B65D 75/04

[52] U.S. Cl. ..... 206/432; 206/433; 229/42

[58] Field of Search ..... 206/45.33, 72, 427, 206/431–433, 497, 526; 229/29 E, 42, 15, DIG. 4, DIG. 1

[56] References Cited

U.S. PATENT DOCUMENTS

| | | | |
|---|---|---|---|
| 2,628,762 | 2/1953 | Spalding | 229/42 X |
| 3,365,110 | 1/1968 | Salomone | 206/432 X |
| 3,595,384 | 7/1971 | Sargent et al. | 206/432 |
| 3,662,879 | 5/1972 | Helms | 206/433 |
| 3,682,367 | 8/1972 | Rohde et al. | 229/42 |
| 3,746,160 | 7/1973 | Thompson et al. | 206/432 X |
| 3,826,357 | 7/1974 | Roth | 206/497 X |

FOREIGN PATENT DOCUMENTS

| | | | |
|---|---|---|---|
| 1,145,424 | 3/1969 | United Kingdom | 206/432 |

*Primary Examiner*—Steven E. Lipman
*Attorney, Agent, or Firm*—Elliot A. Lackenbach; John V. Gorman; Richard C. Witte

[57] ABSTRACT

An internal support member for a shrink wrapped package of identical articles arranged in a layer or layers on a base comprises a single generally rectangular sheet of relatively rigid material formed with at least two preferably six parallel folds that extend vertically when the sheet is stood on edge on the base. The folds define compressive load-bearing side portions which are disposed longitudinally and laterally between the articles in the layer to provide a stable non-tilting support for a similar package stacked thereon.

3 Claims, 8 Drawing Figures

SUPPORT MEMBER FOR SHRINK WRAPPED ARTICLES

FIELD OF THE INVENTION

This invention relates to packages including internal separators for protecting articles (for example bottles) contained within the packages against damage. More particularly it concerns shrink wrapped packages in which an array, formed of one or more layers of generally identical articles arranged in rows, is supported on a base and provided with an external covering of a film of plastics material shrunk on to the array to maintain its integrity.

BACKGROUND OF THE INVENTION

The use of inserts for separating articles in a case is well-known, of course. Such inserts are generally used to separate fragile articles such as bottles so as to reduce the danger of breakage during storage or transit. Such inserts often take the form of a criss-cross of sheets of packaging material, the criss-cross defining compartments within which the articles are individually contained.

Generally, however, the case itself constitutes the loadbearing member of such a package, i.e. the member which would, for example, carry the weight of a stack of cases loaded on top of the package, and the separators are not required to bear any load.

With the advent of large shops and supermarkets, the problem of more effective, yet inexpensive, presentation of goods to prospective purchasers has arisen, and this has encouraged the development of packages which can also serve as components of display stands. In particular, the use of shrink-wrap packs having only wrapping material for vertical sides, has now become popular, and since the outer envelope of shrink-wrap packs is inadequate for resisting compressive forces acting on the pack, additional structural support is necessary.

Packaging inserts designed to act as load-bearing members are already known in principle. Thus, British patent specification No. 1,103,798 describes a one-piece packaging insert suitable for use in a shrink-wrap pack, which combines the two functions of separating articles and protecting them from compressive forces. However, there is an overriding factor in the choice of such an insert, i.e. that it should be simple and cheap, whereas known packaging support members are comparatively complex. Accordingly an object of the present invention is the provision of a simple inexpensive load bearing insert member for use in a shrink wrapped package.

A further object of the present invention is the provision of a load bearing insert member that will provide a suitable stable platform for stacking further packages thereon.

A still further object of the invention is the provision of a load bearing insert member that, in position, will not completely shield from view any article at the periphery of the layer(s) in the package. These and other objects are accomplished by the invention hereinafter set forth.

SUMMARY OF THE INVENTION

According to the present invention, a package comprising a shrink-wrapped array of generally identical articles arranged in at least one layer, includes a support member for resisting compressive forces directed perpendicular to the layer, the member being formed from a sheet of thin, relatively rigid material folded along at least two generally parallel fold lines, each traversing the array in the intended direction of compression and terminating in opposite load-bearing edges of the sheet, the member being disposed in the package in such a way that no article at the periphery of the layer is completely shielded from external side view, and that the package is not liable to tilt when balanced on the support member on a horizontal surface. Preferably the material is folded along six parallel lines, which leads to a particularly convenient arrangement. Conveniently the layer or layers are supported on a base on which the support member stands on edge.

DETAILED DESCRIPTION OF THE INVENTION

The invention will now be more particularly described with reference to the accompanying drawings in which.

Figure 1:
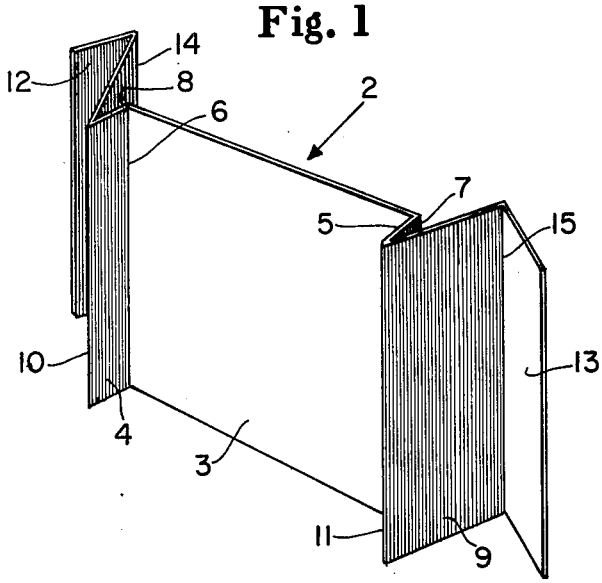
FIG. 1 is a perspective view of a preferred structural member.

FIGS. 1 to 4 illustrate the application of the invention to shrink-wrap packages comprising a single layer of (e.g. plastic) bottles 1 in a rectangular array having three rows of bottles along its short dimension. The layer 1 is supported by a base or tray 17 of rigid material. Support members suitable for such packages may be formed from a rectangular piece of material folded about six fold lines as described below. Thus preferred support member 2 comprises a central portion 3, two inner intermediate side portions 4,5 attached one to each end of the central portion by in-folds 6,7, two outer intermediate side portions 8,9 attached, one to each inner intermediate portion, by outfolds 10, 11, and two terminal side portions 12,13 attached, one to each outer intermediate portion, by infolds 14,15. Each fold extends from the lower edge on which the support member 2 stands to its upper or distal edge. Furthermore the folds or creases are orientated such that they are generally parallel to each other and to the direction of the compressive stress to which the array is likely to be subjected. The linear dimension of the sheet in the direction of the folds is such that in position, the member extends above the upper surface of the array so that it absorbs any compressive stress exerted on the package. In this specification, the terms 'infold' and 'outfold' have a purely relative meaning and denote that the material is folded or creased in opposite senses about the respective fold line. The precise shape and size of the structural member will of course depend upon the size and pattern of the array of collated articles within the package and also upon the location of the support member within the interstices of the array. Thus, the articles may be collated in square, rectangular or even hexagonal array; there may be more than one layer of articles; more than one support member may be used; the support member or members may lie, in part, at the perimeter of the layer or layers providing that the support member is not readily visible when the package is set up for display and provided no peripheral article is completely hidden when the package is viewed from the side. In the preferred embodiments, however, the support member is located between the outer pair of rows or rings in the layer or layers so that the compressive load is evenly distributed over the whole of the member. Additionally, as the distal edges of the load bearing side portions lie in a plane parallel to the base 17 each package in a display stand may be balanced evenly upon the support member of the package directly beneath it in the stand.

In use, the support member is inserted to stand between the outer pairs of rows of the package so that the member is substantially shielded from side view by the peripheral articles. The central portion 3 of the support member is arranged to extend lengthways along the package while the outer intermediate portions 8,9 extend widthwise across the package. The inner intermediate portions 4,5 each project outwardly from the central portion 3 towards the perimeter of the package so that the widthwise extension of the support member can be somewhat greater than the distance between the corresponding parallel interstitial planes. Finally, the terminal portions 12,13 of the support member preferably project acutely from the outer intermediate portions towards the perimeter of the package: this not only provides additional, strong load-bearing portions, but also leads to improved stability against lateral shearing forces caused, for instance, by one package being pushed along the top of a second. In this embodiment, central portion 3 consitutes about 40% of the length of the sheet, while inner intermediate portions 4, 5 outer intermediate portions 8,9 and terminal portions 12, 13 constitute about 4%, 19% and 7% of the length of the sheet, respectively. The support member may be composed of any cellulosic, metallic or plastics material that is rigid but capable of being folded or creased. Card board or fibre board is most conveniently used, preferably a corrugated fibre board such as 'B' flute corrugated fibre board. Preferably the corrugations of the fibre board run in parallel with the fold lines of the support member. The folds themselves are preferably formed by rotary embossing.

Figure 2:
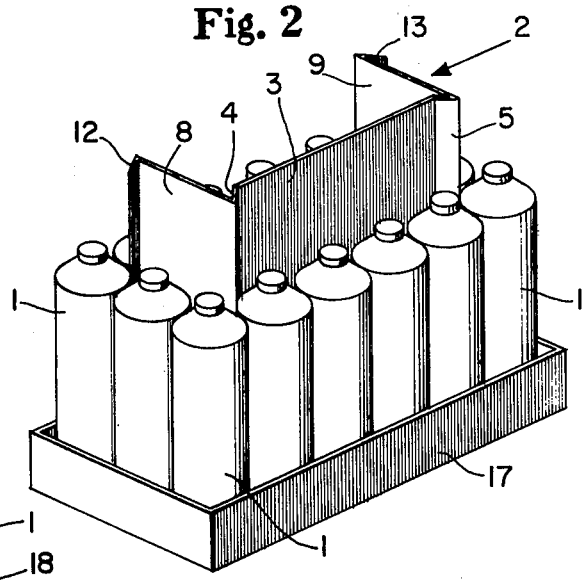
FIG. 2 is perspective view of the structural support member of FIG. 1 in position in an array of collated articles.
Figure 3:
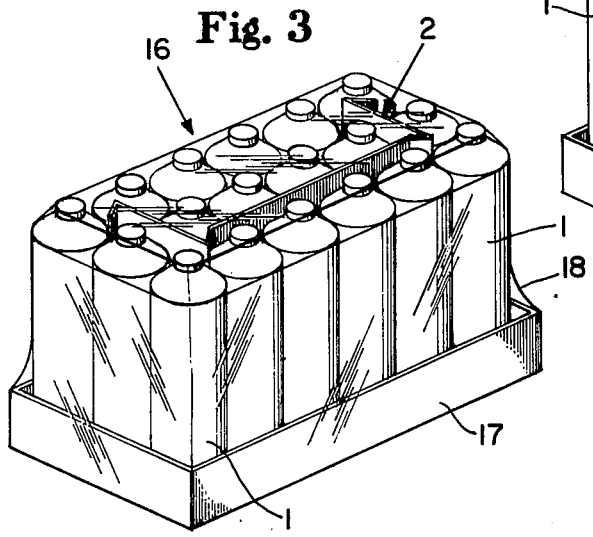
FIG. 3 is a perspective view of a completed shrink-wrap package including the array of FIG. 2.
Figure 4:
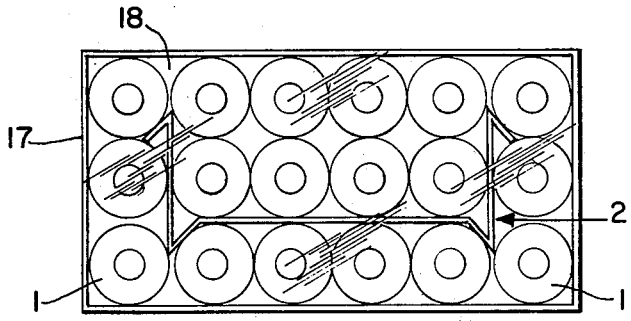
FIG. 4 is a plan view of the package of FIG. 3.
Figure 5:
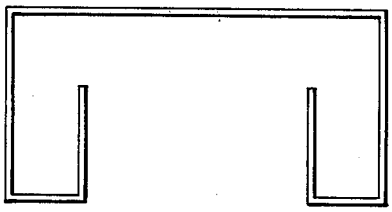
FIG. 5 to 8 are plan views of other suitable structural support members.
Figure 6:
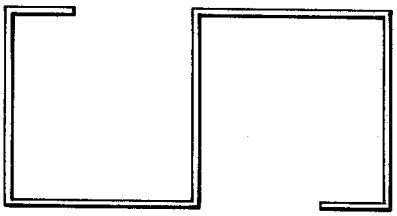
Figure 7:
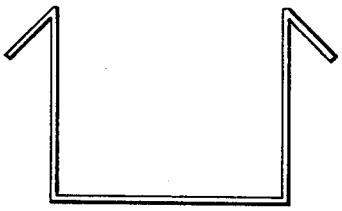
Figure 8:
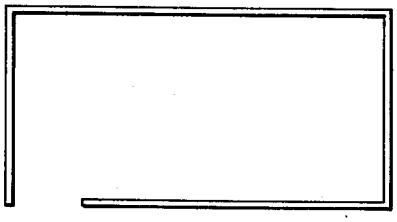

As mentioned previously, the invention is particularly applicable to a shrink-wrap package 16 as illustrated in FIG. 3. As shown in FIG. 2, the folded insert of FIG. 1 may be placed among the containers assembled on the tray by insertion from the top. Alternatively the articles may be assembled about the support member, for instance, by automatically ordering and arranging containers on a moving conveyor belt so as to surround the packaging insert.

The wrapper 18 is suitably made of 0.003 inch thick polyethylene, oriented so that it may be heat-shrunk in two perpendicular directions. It is preferably supplied in roll form as a continuous web folded along a longitudinal fold, so that it emerges from its roll as two films joined along one of their edges. This web may suitably be used for shrink-wrapping the above assembly by placing the tray, with the containers and support member in position, between the two thicknesses of film and against the longitudinal fold. Th film thicknesses are then sealed together, e.g. by hot wire, giving seals respectively parallel and perpendicular to the longitudinal fold on three sides of the assembly of containers, thereby completely enclosing the containers, base and support member in the film. The package so formed is separated from the remaining plastic web, and is placed in a heated air oven; this causes the film to shrink around the base and support member, giving an assembly 16 as shown in FIG. 3.

While the invention has been described primarily in terms of a shrink-wrap package in which the support member is formed from a rectangular blank of material folded along six fold lines, many other forms of support member may be used. Thus FIGS. 5 to 8 illustrate further examples of support members which may be used in the packages of the invention, particularly when the shorter dimension of the package is at least four articles wide. As may be seen, the number of parallel fold-lines ranges from six down to three, and in the limit, only two such lines is sufficient. The wrapper 18 may be made from any other suitable heat shrinkable film conventionally used in shrink-wrapping, such as polyvinylchloride or polystyrene. The film may have either biaxial or uniaxial shrink characteristics, and may be supplied either as a single folded sheet, as described above, or as two separate coextensive sheets which are sealed about the articles along seal lines perpendicular to the longitudinal axis of the sheets.

What is claimed is:

1. In a package comprising a base, a shrink wrapped array of generally identical articles arranged in at least one layer so as to be supported on said base and a support member disposed edgewise on said base to resist compressive forces directed perpendicular to the layer, the improvement in which the support member is of integral, one-piece construction consisting of a generally rectangular single sheet of thin relatively rigid material folded along six generally parallel lines arranged in two symmetrically disposed groups, said lines extending the full height of the support member and substantially perpendicular from the edge on which the support member stands to the opposed distal edge thereof, said lines defining a planar central portion, two inner intermediate load bearing side portions respectively attached to and along the opposite side edges of the central portion by means of infolds, said inner intermediate load bearing side portions projecting to a first side of the plane of the central portion, two outer intermediate load bearing side portions respectively attached to and along the outer side edges of the inner intermediate side portions by outfolds, said outer intermediate load bearing side portions projecting beyond the plane of the central portion to the second side thereof, said load bearing side portions being formed with distal edges that lie in a plane parallel to the base, the support member being located in the interstices of the array such that a longitudinal and two lateral interstitial planes thereof are respectively coincident with the central portion and the outer intermediate load bearing side portions of the support member whereby the load bearing side portions are self adjustably movable while remaining perpendicular the base and the distal edges of the load bearing side portions provide a stable non-tilting support for another such package placed on the distal edges, and whereby the support member is substantially shielded from external side view while no article at the periphery of the layer is completely shielded from external side view.

2. The improvement of claim 1 including two terminal portions respectively attached to and along the outer side edges of the outer intermediate load bearing side portions by means of infolds, said terminal portions terminating short of the plane of the central portion.

3. The improvement of claim 1 wherein the support member is located between the outer pair of rows of articles in a layer or layers of an array.

* * * * *